United States Patent [19]

Chessin et al.

[11] 4,183,789

[45] Jan. 15, 1980

[54] ANODE BAG BENEFACTION

[75] Inventors: Hyman Chessin, West Bloomfield; Edgar J. Seyb, Jr., Berkley, both of Mich.

[73] Assignee: M&T Chemicals Inc., Stamford, Conn.

[21] Appl. No.: 926,432

[22] Filed: Jul. 20, 1978

Related U.S. Application Data

[63] Continuation of Ser. No. 782,899, Mar. 30, 1977, abandoned.

[51] Int. Cl.[2] ..... C25D 3/12; C25D 3/56

[52] U.S. Cl. ..... 204/43 T; 204/48; 204/49

[58] Field of Search ..... 204/43 T, 43 P, 43 N, 204/48, 49, 112, 123

[56] References Cited

U.S. PATENT DOCUMENTS

| | | | |
|---|---|---|---|
| 2,061,592 | 11/1936 | Rapids | 204/49 X |
| 2,316,917 | 4/1943 | Wallace et al. | 204/48 X |
| 2,507,400 | 5/1950 | DeMarinis | 204/43 T |
| 3,114,687 | 12/1963 | Brandt | 204/112 |
| 3,994,787 | 11/1976 | Pfeil et al. | 204/49 |

FOREIGN PATENT DOCUMENTS

| | | | |
|---|---|---|---|
| 1281911 | 12/1961 | France | 204/43 T |

OTHER PUBLICATIONS

J. K. Dennis et al., "Nickel and Chromium Plating", pp. 138–139, (1972).

Duane W. Endicott et al., Plating, vol. 53, No. 1, pp. 43–60, (1966).

Chemical Abstracts, vol. 72, p. 540, 38174j, (1970).

Hackh's—Chemical Dictionary, p. 904, (1944).

*Primary Examiner*—G. L. Kaplan

*Attorney, Agent, or Firm*—Kenneth G. Wheeless; Robert Spector

[57] ABSTRACT

In accordance with certain of its aspects this invention relates to a process and composition for the prevention of anode bag clogging in the preparation of an electrodeposit which contains nickel or; binary or ternary alloys of the metals selected from nickel, iron and cobalt; which comprises passing current from an anode to a cathode through an aqueous acidic electroplating solution containing at least one member selected from the group consisting of nickel compounds and cobalt compounds and which may additionally contain iron compounds providing nickel, cobalt and iron ions for electrodepositing nickel, cobalt, nickel-cobalt alloys, nickel-iron alloys, cobalt-iron alloys or nickel-iron-cobalt alloys and containing an amount of oxalic acid break-down product; the improvement comprising the presence of $2\times10^{-3}$ mole per liter to 1.0 mole per liter of a calcium compound or salt thereby preventing the clogging of anode bags by precipitation of calcium oxalate.

6 Claims, No Drawings

ANODE BAG BENEFACTION

This is a continuation of application Ser. No. 782,899, filed Mar. 30, 1977 and now abandoned.

This invention relates to improved processes and compositions for the electrodeposition of nickel and iron alloys with nickel or nickel-cobalt. More particularly, this invention relates to the use of new additives to prevent the clogging of anode bags in the plating of nickel and nickel-containing alloys of iron and cobalt.

BACKGROUND OF THE INVENTION

Certain plating baths, in particular nickel and nickel-iron or other nickel alloy plating baths, will contain as additives organic materials. In many cases organics are complexers or reducers and as part of the reactions in the electrolytic baths, these organic compounds will decompose and/or react. A common decomposition or reaction product is the oxalate ion. The oxalate ion may be formed as a result of direct electrolytic decomposition or even of decomposition resulting from the presence of oxygen (or other oxidizers) formed at the anodes or introduced by air agitation. It is commonly formed in baths containing gluconates, ascorbates, erythorbates, other carbohydrates and the like.

As a result of the formation of the oxalate ion (however formed in the bath) a precipitate of insoluble nickel oxalate has been forming in these baths and, in particular, this precipitate (which may contain other occluded or absorbed materials such as carbonaceous materials or insoluble sulfides) has been forming in and about the anode bag cloth material. Eventually these anode bags become both hardened and clogged with this material so that flow of the electrolytic solution is impeded. When the process has proceeded far enough, it becomes necessary to remove the old bags and replace them with new ones, an expensive operation.

There are, in general, two ways that the insolubilizing cation can be introduced to the plating bath:

1. The cation could be added in the form of a soluble salt, e.g., as calcium sulfate. In such case beneficial actions may be obtained by general precipitation of the oxalate (i.e., calcium oxalate) in a form which does not clog the anode bags even though some is formed therein and by the fact that this other oxalate does not form the hardened matrix layer now formed by nickel oxalate. Of course, the precipitate must not deteriorate the electrodeposit.

2. The cation could be introduced as part of a sparingly soluble salt and preferably before a filter element. In parallel to the case above, calcium fluoride may be added. In these cases locally higher concentrations of the sparingly soluble salt would cause exchange of the anions i.e. the fluoride ion for the oxalate ion and so the general concentration of the oxalate in the body of the electrolyte would be kept low enough to prevent precipitation of nickel oxalate in the anode bags.

OBJECT OF THE INVENTION

It is an object of this invention to provide deposits of nickel, or binary or ternary alloys characterized by the prevention of anode bag clogging. Other objects of this invention will be apparent from the following detailed description of this invention.

DESCRIPTION OF THE INVENTION

In accordance with certain of its aspects, this invention relates to a process for the prevention of anode bag clogging in the preparation of an electrodeposit which contains nickel, which comprises passing current through an aqueous, acidic plating solution containing nickel compounds and which may also contain iron compounds to provide nickel, cobalt and iron ions for electrodepositing nickel, cobalt, or binary or ternary alloys of nickel, cobalt and iron; the improvement comprising the presence of $2\times10^{-3}$ mole per liter to 1.0 mole per liter of a calcium compound or calcium salt, said calcium ionizing, forming calcium oxalate, thereby preventing the formation of nickel oxalate.

The baths of this invention may also contain an effective amount of at least one member selected from the group consisting of:

(a) Class I brighteners
(b) Class II brighteners
(c) Anti-pitting or wetting agents
(d) Iron complexing or solubilizing agent(s)

The term "Class I brighteners" as used herein, and as described in *Modern Electroplating,* Third Edition, F. Lowenheim, Editor, is meant to include aromatic sulfonates, sulfonamides, sulfonimides, etc., as well as aliphatic or aromatic-aliphatic olefinically or acetylenically unsaturated sulfonates, sulfonamides, sulfonimides, etc. Specific examples of such plating additives are:

(1) sodium o-sulfobenzimide
(2) disodium 1,5-naphthalene disulfonate
(3) trisodium 1,3,6-naphthalene trisulfonate
(4) sodium benzene monosulfonate
(5) dibenzene sulfonimide
(6) sodium allyl sulfonate
(7) sodium 3-chloro-2-butene-1-sulfonate
(8) sodium β-styrene sulfonate
(9) sodium propargyl sulfonate
(10) monoallyl sulfamide
(11) diallyl sulfamide
(12) allyl sulfonamide Such plating additive compounds, which may be used singly or in suitable combinations, are desirably employed in amounts ranging from about 0.5 to 10 grams per liter and provide the advantages described in the above reference and which are well known to those skilled in the art of electroplating.

The term "Class II brighteners" as used herein, and as described in *Modern Electroplating,* Third Edition, F. Lowenheim, Editor, is meant to include plating additive compounds such as reaction products of epoxides with alphahydroxy acetylenic alcohols such as diethoxylated 2-butyne-1,4-diol or dipropoxylated 2-butyne-1,4-diol, other acetylenics, N-heterocyclics, active sulfur compounds, dye-stuffs, etc. Specific examples of such plating additives are:

(1) 1,4-di-(β-hydroxyethoxy)-2-butyne
(2) 1,4-di-(β-hydroxy-γ-chloropropoxy)-2-butyne
(3) 1,4-di-(β-,γ-epoxypropoxy)-2-butyne
(4) 1,4-di-(β-hydroxy-γ-butenoxy)-2-butyne
(5) 1,4-di-(2'-hydroxy-4'-oxa-6'-heptenoxy)-2-butyne
(6) N-(2,3-dichloro-2-propenyl)-pyridinium chloride (7) 2,4,6-trimethyl N-propargyl pyridinium bromide
(8) N-allylquinaldinium bromide
(9) 2-butyne-1,4-diol
(10) propargyl alcohol
(11) 2-methyl-3-butyn-2-ol
(12) quinaldyl-N-propanesulfonic acid betaine
(13) quinaldine dimethyl sulfate
(14) N-allylpyridinium bromide
(15) isoquinaldyl-N-propanesulfonic acid betaine
(16) isoquinaldine dimethyl sulfate
(17) N-allylisoquinaldine bromide
(18) disulfonated 1,4-di-(β-hydroxyethoxy)-2-butyne
(19) 1-(β-hydroxyethoxy)-2-propyne
(20) 1-(β-hydroxypropoxy)-2-propyne
(21) sulfonated 1-(β-hydroxyethoxy)-2-propyne
(22) phenosafranin
(23) fuchsin When used alone or in combination, desirably in amounts ranging from about 5 to 1000 milligrams per liter, a Class II brightener may produce no visual effect on the electrodeposit, or may produce semi-lustrous, fine-grained deposits. However, best results are obtained when Class II brighteners are used with one or more Class I brighteners in order to provide optimum deposit luster, rate of brightening, leveling, bright plate current density range, low current density coverage, etc.

The term "anti-pitting or wetting agents" as used herein is meant to include a material which functions to prevent or minimize gas pitting. An anti-pitting agent, when used alone or in combination, desirably in amounts ranging from about 0.05 to 1 gram per liter, may also function to make the baths more compatible with contaminants such as oil, grease, etc. by their emulsifying, dispersing, solubilizing, etc. action on such contaminants and thereby promote attaining of sounder deposits. Preferred anti-pitting agents may include sodium lauryl sulfate, sodium lauryl ether-sulfate and sodium di-alkylsulfosuccinates.

The nickel compounds, cobalt compounds and iron compounds employed to provide nickel, cobalt and iron ions for electrodepositing nickel, cobalt, or binary or ternary alloys of nickel, cobalt and iron, (such as nickel-cobalt, nickel-iron, cobalt-iron and nickel-cobalt-iron alloys) are typically added as the sulfate, chloride, sulfamate or fluoborate salts. The sulfate, chloride, sulfamate or fluoborate salts of nickel or cobalt are employed in concentrations sufficient to provide nickel and/or cobalt ions in the electroplating solutions of this invention in concentrations ranging from about 10 to 150 grams per liter. The iron compounds, such as the sulfate, chloride, etc. when added to the nickel, cobalt, or nickel and cobalt containing electroplating solutions of this invention, are employed in concentrations sufficient to provide iron ions ranging in concentration from about 0.25 to 25 grams per liter. The ratio of nickel ions or cobalt ions or nickel and cobalt ions to iron ions may range from about 50 to 1 to about 5 to 1.

The iron ions in the electroplating solutions of this invention may also be introduced through the use of iron anodes, rather than through the addition of iron compounds. Thus, for example, if some percentage of the total anode area in a nickel electroplating bath is composed of iron anodes, after some period of electrolysis enough iron will have been introduced into the bath by chemical or electrochemical dissolution of the iron anodes to provide the desired concentration of iron ions.

The nickel, cobalt, nickel-cobalt, nickel-iron, cobalt-iron and nickel-cobalt-iron electroplating baths of this invention additionally may contain from about 30 to 60 grams per liter, preferably about 45 grams per liter of boric acid or other buffering agents to control the pH (e.g. from about 2.5 to 5, preferably about 3 to 4) and to prevent high current density burning.

When iron ions are present in the plating baths of this invention, the inclusion of one or more iron complexing, chelating, anti-oxidizing, reducing, or other iron solubilizing agents such as citric, malic, glutaric, gluconic, ascorbic, isoascorbic, muconic, glutamic, glycollic, and aspartic acids or similar acids or their salts are desirable in the iron containing baths to solubilize iron ions. These iron complexing or solubilizing agents may range in concentration in the plating solution from about one gram per liter to about 100 grams per liter, depending on how much iron is present in the plating bath.

In order to prevent "burning" of high current density areas, provide for more even temperature control of the solution, and control the amount of iron in the iron containing alloy deposits, solution agitation may be employed. Air agitation, mechanical stirring, pumping, cathode rod and other means of solution agitation are all satisfactory. Additionally, the bath may be operated without agitation.

The operating temperature of the electroplating baths of this invention may range from about 40° C. to about 85° C., preferably from about 50° C. to 70°.

The average cathode current density may range from about 0.5 to 12 amperes per square decimeter, with 3 to 6 amperes per square decimeter providing an optimum range.

Typical aqueous nickel-containing electroplating baths (which may be used in combination with effective amounts of cooperating additives) include the following wherein all concentrations are in grams per liter (g/l) unless otherwise indicated:

TABLE I

AQUEOUS NICKEL-CONTAINING ELECTROPLATING BATHS

| | Minimum | Maximum | Preferred |
|---|---|---|---|
| Component: | | | |
| $NiSO_4 . 6H_2O$ | 75 | 500 | 300 |
| $NiCl_2 . 6H_2O$ | 20 | 100 | 60 |
| $H_3BO_3$ | 30 | 60 | 45 |
| pH (electrometric) | 3 | 5 | 4 |

When ferrous sulfate ($FeSO_4.7H_2O$) is included in the foregoing bath the concentration is about 2.5 grams per liter to about 125 grams per liter.

Typical sulfamate-type nickel plating baths which may be used in the practice of this invention may include the following components:

TABLE II

| | Minimum | Maximum | Preferred |
|---|---|---|---|
| Component: | | | |
| Nickel Sulfamate | 100 | 500 | 375 |
| $NiCl_2 . 6H_2O$ | 10 | 100 | 60 |
| $H_3BO_3$ | 30 | 60 | 45 |
| pH (Electrometric) | 3 | 5 | 4 |

When ferrous sulfate ($FeSO_4.7H_2O$) is included in the foregoing bath the concentration is about 2.5 grams per liter to about 125 grams per liter.

Typical chloride-free sulfate-type nickel plating baths which may be used in the practice of this invention may include the following components:

TABLE III

| | Minimum | Maximum | Preferred |
|---|---|---|---|
| Component: | | | |
| $NiSO_4 . 6H_2O$ | 100 | 500 | 300 |
| $H_3BO_3$ | 30 | 60 | 45 |
| pH (Electrometric) | 2.5 | 4 | 3-3.5 |

When ferrous sulfate ($FeSO_4.7H_2O$) is included in the foregoing baths the concentration is about 2.5 grams per liter to about 125 grams per liter.

Typical chloride-free sulfamate-type nickel plating baths which may be used in the practice of this invention may include the following components:

TABLE IV

| | Minimum | Maximum | Preferred |
|---|---|---|---|
| Component: | | | |
| Nickel sulfamate | 200 | 500 | 350 |
| $H_3BO_3$ | 30 | 60 | 45 |
| pH (Electrometric) | 2.5 | 4 | 3-3.5 |

When ferrous sulfate ($FeSO_4.7H_2O$) is included in the foregoing baths the concentration is about 2.5 grams per liter to about 125 grams per liter.

The following are aqueous cobalt-containing and cobalt-nickel-containing electroplating baths which may be used in the practice of this invention:

TABLE V

AQUEOUS COBALT-CONTAINING AND COLBALT-NICKEL-CONTAINING ELECTROPLATING BATHS (All concentrations in g/l unless otherwise noted)

| | Minimum | Maximum | Preferred |
|---|---|---|---|
| Cobalt bath | | | |
| $CoSO_4 . 7H_2O$ | 50 | 500 | 300 |
| $CoCl_2 . 6H_2O$ | 15 | 125 | 60 |
| $H_3BO_3$ | 30 | 60 | 45 |
| $CoSO_4 . 7H_2O$ | 100 | 500 | 400 |
| NaCl | 15 | 60 | 30 |
| $H_3BO_3$ | 30 | 60 | 45 |
| High chloride cobalt bath | | | |
| $CoSO_4 . 7H_2O$ | 75 | 350 | 225 |
| $CoCl_2 . 6H_2O$ | 50 | 350 | 225 |
| $H_3BO_3$ | 30 | 60 | 45 |
| Cobalt-nickel alloy bath | | | |
| $NiSO_4 . 6H_2O$ | 75 | 400 | 300 |
| $CoSO_4 . 7H_2O$ | 15 | 300 | 80 |
| $NiCl_2 . 6H_2O$ | 15 | 75 | 60 |
| $H_3BO_3$ | 30 | 60 | 45 |
| All-chloride cobalt bath | | | |
| $CoCl_2 . 6H_2O$ | 100 | 500 | 300 |
| $H_3BO_3$ | 30 | 60 | 45 |
| Sulfamate cobalt bath | | | |
| Cobalt sulfamate | 100 | 400 | 290 |
| $CoCl_2 . 6H_2O$ | 15 | 75 | 60 |
| $H_3BO_3$ | 30 | 60 | 45 |

The pH in the typical formulations of Table V may range from about 3 to 5 with 4 preferred.

When ferrous sulfate ($FeSO_4.7H_2O$) is included in the foregoing baths the concentration is about 2.5 grams per liter to 125 grams per liter.

Typical nickel-iron containing electroplating baths which may be used in the practice of this invention may include the following components:

TABLE VI

| | Minimum | Maximum | Preferred |
|---|---|---|---|
| Component: | | | |
| $NiSO_4 . 6H_2O$ | 20 | 500 | 200 |
| $NiCl_2 . 6H_2O$ | 15 | 300 | 60 |
| $FeSO_4 . 7H_2O$ | 1 | 125 | 40 |
| $H_3BO_3$ | 30 | 60 | 45 |
| pH (Electrometric) | 2.5 | 5 | 3.5-4 |

With the inclusion of ferrous sulfate ($FeSO_4.7H_2O$) in the foregoing bath formulations it is desirable to additionally include one or more iron complexing, chelating or solubilizing agents ranging in concentration from about 1 gram per liter to about 100 grams per liter, depending, of course, on the actual iron concentration.

It will be apparent that the above baths may contain compounds in amounts falling outside the preferred minimum and maximum set forth, but most satisfactory and economical operation may normally be effected when the compounds are present in the baths in the amounts indicated. A particular advantage of the chloride-free baths of Tables III and IV, supra, is that the deposits obtained may be substantially free of tensile stress and may permit high speed plating involving the use of "high speed" anodes.

The pH of all of the foregoing illustrative aqueous nickel-containing, cobalt-containing, nickel-cobalt-containing, nickel-iron, cobalt-iron and nickel-cobalt-iron-containing compositions may be maintained during plating at pH values of 2.5 to 5.0, and preferably from about 3.0 to 4.0. During bath operation, the pH may normally tend to rise and may be adjusted with acids such as hydrochloric acid, sulfuric acid, etc.

Anodes used in the above baths may consist of the particular single metal being plated at the cathode such as nickel or cobalt for plating nickel or cobalt respectively. For plating binary or ternary alloys such as nickel-cobalt, cobalt-iron, nickel-iron or nickel-cobalt-iron, the anodes may consist of the separate metals involved suitably suspended in the bath as bars, strips or small chunks in titanium baskets. In such cases the ratio of the separate metal anode areas is adjusted to correspond to the particular cathode alloy composition desired. For plating binary or ternary alloys one may also use as anodes alloys of the metals involved in such a percent weight ratio of the separate metals as to correspond to the percent weight ratio of the same metals in the cathode alloy deposits desired. These two types of anode systems will generally result in a fairly constant bath metal ion concentration for the respective metals. If with fixed metal ratio alloy anodes there does occur some bath ion imbalance, occasional adjustments may be made by adding the appropriate corrective concentration of the individual metal salts. All anodes are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel-containing, cobalt-containing, nickel-cobalt-containing, nickel-iron-containing, cobalt-iron-containing or nickel-cobalt-iron-containing electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel, copper, tin and alloys thereof such as with lead, alloys of copper such as brass, bronze, etc., zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the cobalt, nickel, or iron containing electroplate applied on such substrates.

While nickel, cobalt, nickel-cobalt, nickel-iron, cobalt-iron or nickel-iron-cobalt electrodeposits can be obtained employing the various parameters described above, the brightness, leveling, ductility and covering power may not be sufficient or satisfactory for a particular application. In addition, the deposit may be hazy or dull, and also exhibit striations and step plate. These conditions may especially result after the addition of excessive replenishment amounts of Class II brighteners, or from the use of especially "powerful" Class II brighteners. In the case of the iron-containing plating baths which additionally contain iron solubilizing agents, the solubilizing agents may also cause a loss of leveling and brightness, or may result in hazy, dull or striated deposits.

The following examples are submitted for the purpose of illustration only and are not to be construed as limiting the scope of the invention in any way.

EXAMPLE 1

A nickel electroplating bath composition was prepared by combining in water the following ingredients to provide the indicated concentrations (in g/l unless indicated otherwise).

| | Concentration (g/l) |
|---|---|
| $NiSO_4 . 7H_2O$ | 380 |
| $NiCl_2 . 6H_2O$ | 60 |
| $H_3BO_3$ | 45 |
| ferrous sulfate ($FeSO_4 . 7H_2O$) | 40 |
| Reaction product of Butyne Diol with 2 moles of Ethylene Oxide | 50 mg/l |
| sodium saccharinate (0.6 mole $H_2O$) | 4.0 |
| sodium allyl sulfonate | 2.3 |
| fructose | 20 |
| pH | 3.3 |

A 250 milliliter portion of the above was saturated with oxalic acid, filtered, and the pH adjusted to 4.2. Test tubes were each filled with approximately 20 milliliters of the prepared plating solution. To separate test tubes were added aliguots of calcium carbonate. After 85 minutes, all test tubes contained precipitates in the bottom showing that calcium carbonate precipitates oxalate to reduce the concentration in plating baths and prevent nickel oxalate from clogging anode bags.

EXAMPLE 2

Strips of anode bag material encrusted with nickel oxalate and other occluded salts were placed in 250 milliliter beakers. 200 milliliters of nickel-iron plating solution were poured into each of two beakers. 10 g of calcium chloride was added to the experimental beaker; the other was retained as a control. The beakers were placed in a temperature controlled water bath at 58° C. and stirred daily for 18 days. At the end of this period it was noted that the cloth strip in the control beaker had not changed, i.e., it was still hard and stiff whereas that in the experimental beaker was softer and more pliable, indicating that the nickel oxalate had been removed. Although this invention has been illustrated by reference to specific embodiments, modifications thereof which are clearly within the scope of the invention will be apparent to those skilled in the art.

What is claimed is:

1. A process for the prevention of anode bag clogging in the preparation of an electrodeposit which contains nickel or; binary or ternary alloys of the metals selected from nickel, iron and cobalt; which comprises passing current from an anode to a cathode through an aqueous acidic electroplating solution containing nickel compounds and which may additionally contain iron compounds providing nickel and iron ions for electrodepositing nickel, cobalt, nickel-cobalt alloys, nickel-iron alloys, cobalt-iron alloys or nickel-iron-cobalt alloys and containing an amount of oxalic acid break-down product; the improvement comprising the presence of $2\times10^{-3}$ mole per liter to 1.0 mole per liter of a calcium compound thereby preventing the clogging of anode bags by precipitation of calcium oxalate and subsequently maintaining the concentration of free calcium ion in an amount greater than the solubility constant of calcium oxalate.

2. The process of claim 1 wherein said nickel compounds are nickel sulfate and nickel chloride.

3. The process of claim 1 wherein said nickel compounds are nickel sulfamate and nickel chloride.

4. The process of claim 1 wherein said cobalt compounds are cobalt sulfate and cobalt chloride.

5. The process of claim 1 wherein said cobalt compounds are cobalt sulfamate and cobalt chloride.

6. The process of claim 1 wherein said ferrous compound is ferrous sulfate or ferrous chloride.

* * * * *